United States Patent [19]

Kuo

[11] 4,162,204

[45] Jul. 24, 1979

[54] PLATED METALLIC CATHODE

[75] Inventor: Han C. Kuo, Cleveland, Tenn.

[73] Assignee: Olin Corporation, New Haven, Conn.

[21] Appl. No.: 892,554

[22] Filed: Apr. 3, 1978

[51] Int. Cl.[2] ..... C25D 3/56; C25D 3/02; C25D 17/10

[52] U.S. Cl. ..... 204/43 R; 204/43 T; 204/290 R

[58] Field of Search ..... 204/43 R, 43 T

[56] References Cited

U.S. PATENT DOCUMENTS 3,947,331 3/1976 Kinh et al. ..... 204/37 R

OTHER PUBLICATIONS

Stason et al., Soviet Electrochem 8 1296–1297, (1972).

Imanage, Koygo Kagaku Zasshi 66 (12), 1792–1795, (1963).

Higashi et al., Kinzoku Hyomen Gijyutsu 27 (11), 590–595, (1976).

*Primary Examiner*—F. C. Edmundson

*Attorney, Agent, or Firm*—Bruce E. Burdick; Donald F. Clements; Thomas P. O'Day

[57] ABSTRACT

A highly conductive and corrosion resistant low hydrogen overvoltage cathode. The cathode comprises a copper substrate plated with an alloy of nickel and molybdenum.

6 Claims, 2 Drawing Figures

PLATED METALLIC CATHODE

Figure 1:
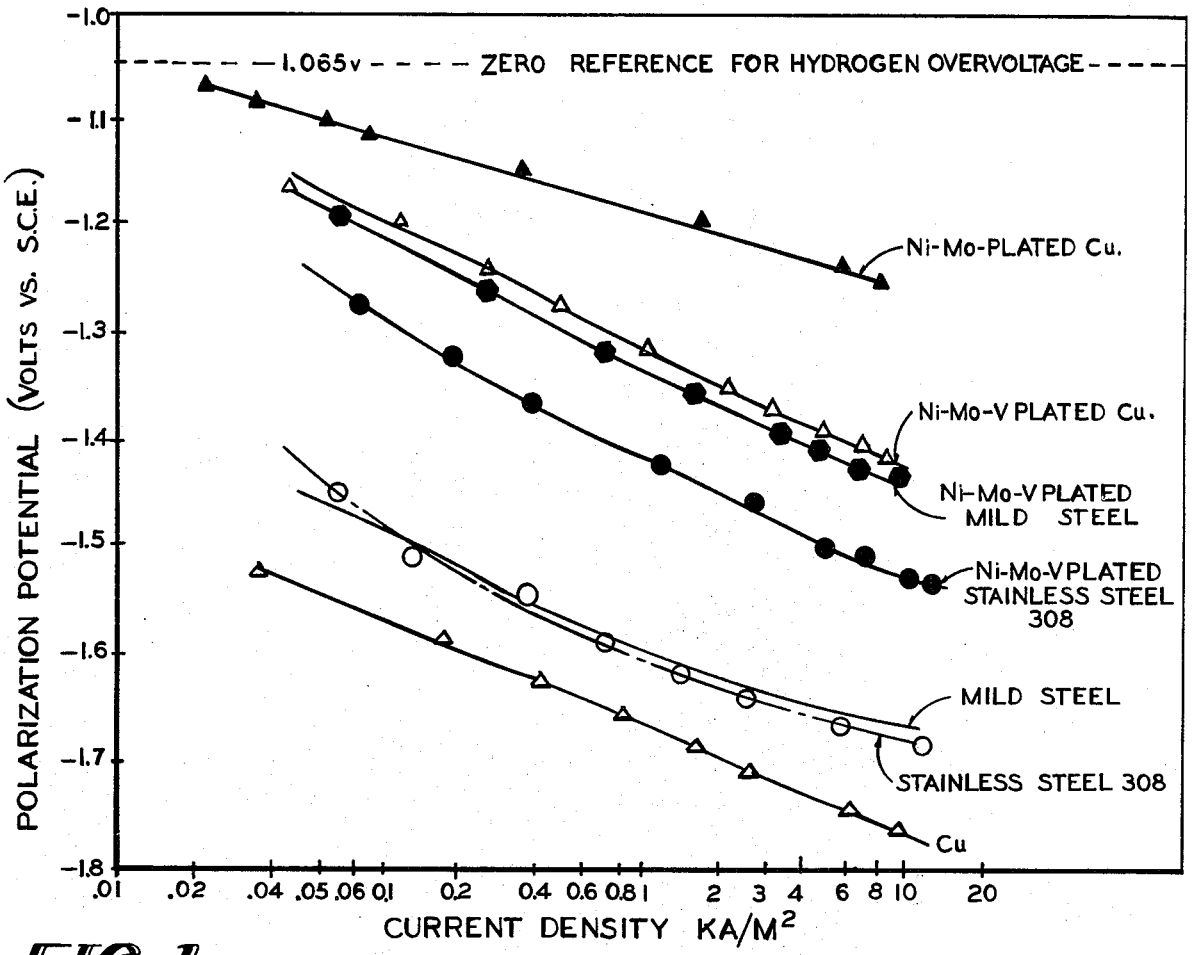

This invention relates generally to a cathode for an electrolytic cell, and more particularly, to a plated metallic cathode for use in such cells.

One of the largest costs in the operation of electrolytic cells is that of electrical energy. Consequently, efforts have been made to reduce the working voltage of the cell. One of the components contributing to the working voltage is the overvoltage at the cathode. In the case of a cell used for the electrolysis of alkali metal chloride solutions, for example, this component is referred to as hydrogen overvoltage.

Previously, cathodes have been constructed of various metals such as low-carbon steel, titanium, nickel, chromium, copper, iron, tantalum, and the like, and alloys thereof, especially stainless steel and other chromium steels, nickel steels, and the like. For a given structural configuration, current density, temperature, and electrolyte, each of these metals when used as a cathode will possess a given overvoltage.

In an article published in *Zeszyty Naukowe Politechniki Slaskiej,* Chemia No. 65, pp. 235 and 236, 1975 (Poland), by Andrzej Malachowski, there is disclosed an electrode having a reduced hydrogen overvoltage. The electrode disclosed in the article comprised a steel substrate plated with a nickel, molybdenum, vanadium alloy. Although the Ni-Mo-V plated steel electrode does have a reduced overvoltage, it has been found to be prone to corrosion, even to the extent that the plating will peel off after a few weeks when the potential is removed.

Similarly, in U.S. Pat. No. 3,291,744, issued to J. R. Hall et al on Dec. 13, 1966, there are disclosed electrodes having reduced overvoltage. The electrodes disclosed in the Hall et al patent comprise a steel or titanium substrate plated with various alloys selected from the group consisting of tungsten-iron, molybdenum-cobalt, molybdenum-nickel (Ni-Mo), molybdenum-iron, molybdenum-iron-cobalt, molybdenum-nickel-iron and molybdenum-nickel-cobalt. However, these electrodes have also been found to be subject to corrosion, even to the extent that the plating will peel off after a few weeks of use in a caustic environment such as when used as the cathode of an electrolytic chlor-alkali cell.

There is further shown in U.S. Pat. No. 4,033,837, issued July 5, 1977 to H. C. Kuo et al, and in U.S. Pat. No. 4,105,531 by H. C. Kuo et al a nickel-molybdenum-vanadium (Ni-Mo-V) alloy plated copper electrode having reduced hydrogen overvoltage. The Kuo et al patent teaches that Ni-Mo-V platings are preferred for producing low overvoltage cathodes. The Kuo et al application teaches that with a pH of 9–11 and a lower vanadium concentration in the plating bath than that suggested by the Kuo et al patent a lower overvoltage is produced but, if the vanadium is decreased below 0.4 g/l, the cathode overvoltage increases.

There is further known from U.S. Pat. No. 3,947,331, issued to V. Q. Kinh et al on Mar. 30, 1976, a 30–40 μm non-fissured Ni-Mo plating over a 10–40 μm fissured Ni-Mo which is in turn plated over a 5–30 micron (μm) non-fissured sublayer of plated nickel on a cleaned copper substrate for corrosion resistance. A lower limit of 5 $A/dm^2$ is specified for plating current density. The outer non-fissured coating is of 30–40 μm and has 15–50 percent by weight molybdenum. The coating is then heat treated at 700°–1200° C. for 2–24 hours. Overvoltage is not considered.

It is an object of the present invention to provide a durable cathode which has a relatively low hydrogen overvoltage.

It is a further object of the present invention to provide an improved cathode having a relatively low hydrogen overvoltage and improved corrosion resistance.

The above objects may be accomplished, according to the preferred form of the invention, through the provision of a cathode comprising a copper substrate plated with a nickel-molybdenum alloy having more than 50 percent by weight molybdenum in a plating bath having a pH greater than 9.0 and having a complexing agent.

Alternatively, a ternary nickel-iron-molybdenum (Ni-Fe-Mo) coating may be substituted for the Ni-Mo alloy coating above.

Figure 2:
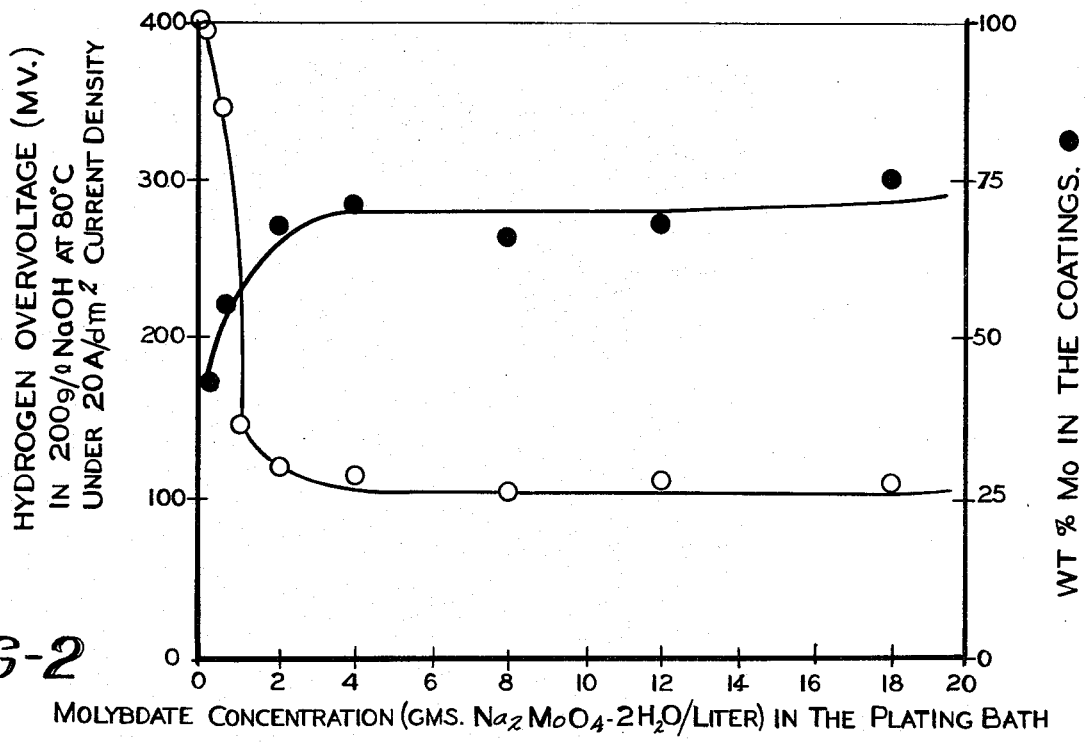

A better understanding of this invention may be had by reference to the following detailed description and to the accompanying drawing in which:

FIG. 1 is a graph plotting the polarization potential against current density for various plated and unplated cathodes including the Ni-Mo coating of the invention; and FIG. 2 is a graph plotting the hydrogen overvoltage and weight percent molybdenum in the coatings as a function of molybdate concentration in the plating bath.

More specifically, it is contemplated that the cathode structure may be of any shape suitable for the intended purpose. For example, the cathode of the present invention may comprise a plate, a rod, a foraminous structure, or mesh of any shape well known in the art.

The cathode is fabricated from a copper substrate to which is applied a plating of an alloy of nickel and molybdenum. The percent by weight of molybdenum in the plating is at least 50 and preferably 60–75. The thickness of the plating may be in the order of 1 to 5 microns. Preferably, the thickness is in the order of about 2 to 4 microns.

The nickel-molybdenum plating is preferably electrodeposited on the copper substrate using a nickel bath with the addition of amounts of molybdenum in a form that will provide a source of ions to be deposited by discharge in an aqueous solution. The bath may be an aqueous solution of nickel salts (nickel sulfate and nickel chloride) in the amount of 20 to 150 g/l (grams per liter), sodium molybdate in the amount of 1 to 40 g/l, and complexing agents in the amount of 20 to 100 g/l. The pH of the plating bath is adjusted so as to fall within the range of about 9.0 to about 11.0 by addition of sodium carbonate. Other sources of molybdenum ion may be used.

Suitable complexing agents are alkali metal citrates, tartrates and pyrophosphates. Particularly preferred are sodium citrate and sodium pyrophosphate. The complexing agent is preferably added in a molar concentration approximately equal to the molar concentration of nickel salts plus molybdenum salts.

About 5–15 grams ferrous salts per liter of plating solution may be added to the plating bath and hence to the coating to produce a ternary Ni-Fe-Mo coating on the copper substrate, giving the plated cathode an overvoltage approximately the same as has the Ni-Mo coated copper cathode, namely 200 to 250 millivolts less than that of a steel cathode.

Prior to immersing the copper substrate in the bath, the surface of the substrate should be cleaned. This can be accomplished by conventional techniques well known in the art for cleaning preparatory to nickel plating. For example, the copper substrate may be etched in a solution containing 10 to 40 percent volume parts sulfuric acid having a concentration of 97 percent $H_2SO_4$ by weight, and 5 to 20 volume parts nitric acid having a concentration of 71 percent $HNO_3$ by weight and 40 to 85 volume parts water for about 5 to 15 minutes at room temperature. Alternatively, it may be cathodically cleaned in a caustic solution of 10 to 20 weight parts sodium hydroxide and 80 to 90 weight parts water at room temperature at 20 to 80 ma/cm$^2$ for about 5 to 10 minutes. After either of the above operations, the copper substrate should be rinsed with deionized water. Prior to immersing the copper substrate into the plating bath, it may be immersed in a solution of about 10 volume parts sulfuric acid having a concentration of 97 percent $H_2SO_4$ by weight, about 10 volume parts hydrochloric acid having a concentration of 37 percent HCl by weight, and about 80 volume parts water, room temperature, for 10 to 40 seconds and then rinsed with deionized water.

The copper cathode may also be cleaned by a 30 percent nitric acid and rinsed with deionized water. Other cleansing procedures may also be used, the cleansing merely serving to remove any film on the copper substrate so as to provide a more adherent coating.

After cleaning, the copper cathode structure may be immersed in the above described plating bath. The bath may have a pH of 9 to 11 and be at a temperature of 20° to 45° C. The plating current density may be 0.4 to 50 A/dm$^2$ and is preferably 3.0–5.0 A/dm$^2$. The plating operation may continue for 15 to 90 minutes until a layer of alloy material has been deposited of a thickness of 1–5 $\mu$m and preferably of 2–4 $\mu$m.

The resulting product is a cathode having a copper substrate with a plating of nickel and at least 50 percent by weight molybdenum.

The cathodes of the present invention unexpectedly and surprising show lower hydrogen overvoltages at various current densities as compared with bare copper, bare mild steel, bare stainless steel 308, Ni-Mo-V plated steel, and Ni-Mo-V plated copper. In addition, the plated copper cathode of the present invention shows improved corrosion resistant properties as compared to a mild steel plated with the same alloy.

The cathode of this invention is particularly useful in chlor-alkali electrolytic cells. However, it is contemplated that it may also be used in the electrolysis of water.

The following examples are presented to better define the invention without any intention of being limited thereby. All parts and percentages are by volume at room temperature unless otherwise indicated. A Luggin capillary tube with a saturated calomel reference electrode was used to monitor overvoltage. A salt bridge of 25 percent brine was inserted between the Luggin capillary and the reference electrode. IR drop during polarization was automatically compensated for by a potentiostat.

EXAMPLE 1

A cleaned ¼ inch diameter copper rod was plated with Ni-Mo alloy in a bath having the following composition:

| INGREDIENT | CONCENTRATION |
|---|---|
| Nickel Sulfate | 79.0 gpl |
| Nickel Chloride | 23.8 gpl |
| Sodium Molybdate | 4.0 gpl |
| Ammonium Tartrate | 73.6 gpl |
| pH = 9.8 | |

at ambient temperature with current density of 4 A/dm$^2$ for 10 minutes.

The hydrogen overvoltage of this plated alloy coating tested in 200 gpl NaOH at 80° C. and 20 A/dm$^2$ current density was about 0.18 v, which is about 0.15 to 0.2 v lower than that of a steel cathode.

EXAMPLE 2

Several cleaned ¼ inch diameter copper rods were plated with the Ni-Mo alloys at ambient temperature for 30 minutes in the bath of the following composition with various molybdate contents.

| INGREDIENT | CONCENTRATION |
|---|---|
| Nickel Sulfate | 78.8 gpl |
| Nickel Chloride | 23.8 gpl |
| Sodium Molybdate | Various - from 0 to 20 gpl |
| Sodium Citrate | 88.0 gpl |
| pH = 9.0 (adjusted with the addition of $Na_2CO_3$) | |

FIG. 2 shows the coating composition and the hydrogen overvoltage, measured in 200 gpl NaOH at 80° C. and 20 A/dm$^2$ current density of the coatings prepared in baths of various molybdate content. The coating plated in a bath containing 2 gpl or more than 2 gpl sodium molybdate exhibited a molybdenum content of about 60 to 75 weight percent and a hydrogen overvoltage of about 0.11 to 0.12 v which is about 0.25 v lower than a conventional steel cathode (overvoltage of steel is about 0.35 to 0.4 v).

EXAMPLE 3

A cleaned ¼ inch diameter copper rod was plated in a bath of the following composition:

| INGREDIENT | CONCENTRATION |
|---|---|
| Nickel Chloride | 95.0 gpl |
| Sodium Citrate | 58.8 gpl |
| Sodium Molybdate | 4.0 gpl |
| pH = 9.5 (adjusted with the addition of $Na_2CO_3$) | |

at ambient temperature, 4 A/dm$^2$ for 10 minutes. The hydrogen overvoltage tested in 200 gpl, 80° C. at 20 A/dm$^2$ is about 0.15 v which is about 0.2 v lower than that of steel.

EXAMPLE 4

Cleaned ¼ inch diameter copper rods were plated at 4 A/dm$^2$ for 30 minutes at various temperatures (26°, 40°, 60° and 80° C.) in a bath having the following composition:

| INGREDIENT | CONCENTRATION |
|---|---|
| Ferrous Chloride | 9.9 gpl |
| Ferrous Sulfate | 41.7 gpl |

-continued

| INGREDIENT | CONCENTRATION |
|---|---|
| Nickel Chloride | 11.5 gpl |
| Nickel Sulfate | 40.0 gpl |
| Sodium Citrate | 88.0 gpl |
| Sodium Molybdate | 6.0 gpl |
| | pH = 9.5 (adjusted by the addition of $Na_2CO_3$) |

The activities of the plated Ni-Fe-Mo alloy coatings at 80° C. and 20 A/dm$^2$ current density were about the same as that of Ni-Mo coating with hydrogen overvoltage of 0.2 to 0.25 v lower than that of a steel cathode.

EXAMPLE 5

A cleaned 50 cm$^2$ copper louvered mesh was plated with an Ni-Mo alloy coating at ambient temperature, 4 A/dm$^2$ for 60 minutes in a bath of the following composition:

| INGREDIENT | CONCENTRATION |
|---|---|
| Nickel Chloride | 23.7 gpl |
| Nickel Sulfate | 30.0 gpl |
| Sodium Citrate | 89.0 gpl |
| Sodium Molybdate | 7.3 gpl |
| | pH = 9.5 |

The plated mesh was put into a chlor-alkali bench scale cell as a cathode operated with Nafion membrane and DSA$^R$ anode. The cell was continuously operated at 20 A/dm$^2$ with 180–250 gpl catholyte for 2 months. The cell with the plated cathode consistently showed about 0.15 to 0.2 v lower cell voltage than that of the same cell operated with a steel cathode. The half cell potential of the coated cathode was about −1.19 to −1.27 v vs. S.C.E. (standard calomel electrode), while that of steel cathode was about −1.430 to −1.5 v vs. S.C.E.

EXAMPLE 6

A cleaned louvered copper mesh of 50 cm$^2$ was plated with an Ni-Mo alloy at ambient temperature, 4 A/dm$^2$ for 30 minutes in a bath having the following composition:

| INGREDIENT | CONCENTRATION |
|---|---|
| Nickel Sulfate | 80.0 gpl |
| Nickel Chloride | 23.0 gpl |
| Sodium Molybdate | 6.0 gpl |
| Sodium Citrate | 88.0 gpl |
| | pH = 9.5 (adjusted by the addition of $Na_2CO_3$) |

The mesh was installed in a bench scale chlor-alkali cell with Nafion membrane and operated at 20 A/dm$^2$ with 200 to 250 gpl catholyte caustic concentration. The cell has been operated for 2 months and consistently shows a cathode half cell potential about −1.23 to −1.29 v vs. S.C.E. The hydrogen overvoltage of the coated cathode is about 0.16–0.2 v lower than that of the steel cathode. The cell voltage of the cell with coated cathode is about 0.16 to 0.2 v lower than that with a steel cathode.

For comparison, two cleaned steel mesh 2½"×3¼" were plated with Ni-Mo alloy in a citrate bath identical to that of EXAMPLE 6 and operated at 20 and 40 A/dm$^2$, respectively. An overvoltage of 0.16–0.20 lower than uncoated steel was initially noted, however both coatings peeled off after about one week of operation and the overvoltage rose to that of aged steel, confirming that the Ni-Mo coatings are adherent to copper substrates without heat treatment of the coatings and not sufficiently adherent to steel substrate.

What is claimed is:

1. Electrolytic method for producing a catalytically coated cathode for an electrolytic cell for the production of an alkali metal hydroxide and halogen gas from an alkali metal halide, said method comprising the steps of:

(a) forming an aqueous solution of alkali metal molybdate at a concentration of 1–40 grams/liter, nickel salts and a complexing agent selected from the group consisting of alkali metal citrates and alkali metal pyrophosphates with proportions adjusted so that the resultant coating contains more than 50 percent by weight of molybdenum, (b) adjusting the pH between 9 and 11, (c) locating a clean support formed of a metal selected from the group consisting of copper and copper base alloys at the cathode in an electrolytic bath of said aqueous solution, and (d) passing current in said bath with a cathodic current density of 0.4 A/dm$^2$ to 50 A/dm$^2$ for a duration sufficient to make said resultant coating from about 1 μm to about 5 μm thick.

2. The method of claim 1 wherein said aqueous solution also contains ferrous salts in the amount of 5–15 grams/liter.

3. The method of claim 1 wherein said current is passed in said bath for from 10 to 90 minutes.

4. The method of claim 1, 2 or 3 wherein said cathodic current density is from 3 A/dm$^2$ to 5 A/dm$^2$.

5. The method of claim 4 wherein said current is passed in said bath for from 50 to 70 minutes.

6. The method of claim 1, wherein said concentration of said alkali metal molybdate is 2–20 grams/liter so that the resultant coating contains 60–75 percent by weight molybdenum.

* * * * *